United States Patent [19]

Ahmed

[11] 4,282,477

[45] Aug. 4, 1981

[54] SERIES VOLTAGE REGULATORS FOR DEVELOPING TEMPERATURE-COMPENSATED VOLTAGES

[75] Inventor: Adel A. A. Ahmed, Clinton Township, Hunterdon County, N.J.

[73] Assignee: RCA Corporation, New York, N.Y.

[21] Appl. No.: 120,471

[22] Filed: Feb. 11, 1980

[51] Int. Cl.[3] ..... G05F 3/04

[52] U.S. Cl. ..... 323/312

[58] Field of Search ..... 307/297; 323/4, 8, 9, 323/17, 19

[56] References Cited

U.S. PATENT DOCUMENTS

| | | | |
|---|---|---|---|
| 3,787,757 | 1/1974 | Sheng | 323/4 |
| 3,851,241 | 11/1974 | Wheatley, Jr. | 323/8 |
| 3,982,174 | 9/1976 | Maddox | 323/17 |
| 4,055,774 | 10/1977 | Ahmed . | |
| 4,071,813 | 1/1978 | Dobkin . | |
| 4,088,941 | 5/1978 | Wheatley, Jr. | 323/19 X |
| 4,140,960 | 2/1979 | Ohsawa | 323/4 |

*Primary Examiner*—William M. Shoop

*Attorney, Agent, or Firm*—E. M. Whitacre; P. J. Rasmussen; Allen LeRoy Limberg

[57] ABSTRACT

Emitter-coupled differential amplifier transistors have their collector currents differentially combined for application to a series regulator transistor in series with a potential divider network having first and second taps to the base electrodes of the emitter-coupled differential amplifier transistors, for completing a feedback loop which develops positive-temperature-coefficient voltages across resistor portions of the potential divider network. These positive-temperature-coefficient voltages augment negative-temperature-coefficient voltages developed across semiconductor diode means included in the potential divider network to provide for zero-temperature-coefficient voltages being developed across the potential divider network or a portion thereof.

14 Claims, 13 Drawing Figures

SERIES VOLTAGE REGULATORS FOR DEVELOPING TEMPERATURE-COMPENSATED VOLTAGES

Figure 1:
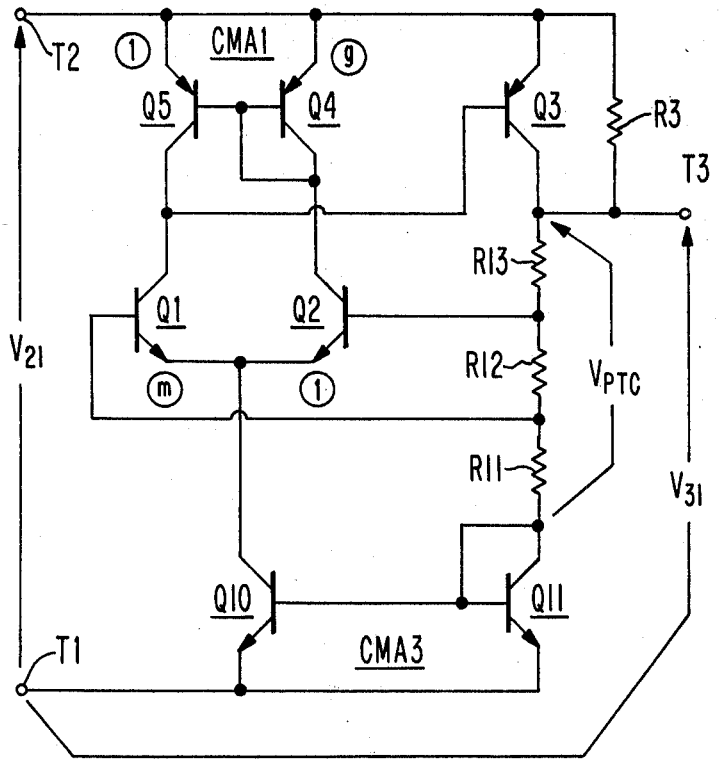

The present invention relates to series voltage regulators for developing temperature-compensated voltages, of the general type wherein the negative-temperature-coefficient voltage developed as offset voltage across a forward biased semiconductor junction (or a series connection of such) is augmented by a positive-temperature-coefficient voltage developed as the difference between the offset voltages developed across similar numbers of forward-biased semiconductor junctions.

C. F. Wheatley, Jr. in U.S. Pat. No. 3,851,241, issued Nov. 26, 1974 and entitled "TEMPERATURE DEPENDENT VOLTAGE REFERENCE CIRCUIT" describes shunt voltage regulator circuits in which a positive-temperature-coefficient offset potential is maintained by direct coupled degenerative feedback between the base electrodes of a long-tailed pair connection of bipolar transistors. These transistors have their collector currents differentially combined to develop an error signal to control the shunt voltage regulator transistor. The proportions in which the collector currents are combined is chosen so that the error signal is reduced nearly to zero only when offset voltage appears between the base electrodes of the long-tailed pair. In U.S. Pat. No. 4,088,941, issued May 9, 1978 and entitled "VOLTAGE REFERENCE CIRCUITS" Wheatley, Jr. scales up the positive-temperature-coefficient difference between the base potentials of the long-tailed pair and adds it to the negative-temperature-coefficient offset potential across forward-biased semiconductor junction diode means to obtain zero-temperature-coefficient shunt regulated voltages.

In an integrated-circuit (i-c) environment, when the unregulated voltage is apt to range substantially upwards from regulated voltage, a shunt voltage regulator has to consume increasing current with increase in unregulated voltage. So power consumption within the regulator circuitry becomes unduly high. This not only wastes power and uses up the heat dissipating capabilities of the i-c package to no avail, but leads to self-heating of the regulator elements. This self-heating is thermal feedback which tends to tax the temperature-compensating properties of the regulator and to result in a reduced range of satisfactory temperature compensation. Further, as loading in a shunt regulator is decreased the shunt regulator assumes the demand for current previously placed by the load circuit, so the power demanded from the regulated supply is not reduced. This wastes power in a voltage regulator subject to changing loading, particularly if full loading is infrequent, and again thermal regeneration can reduce the range and accuracy of temperature compensation. These shortcomings can be alleviated by recourse for a series regulator where essentially only the power demanded from the unregulated voltage supply can be kept to not much more than that required to supply the load imposed on the regulator.

The present invention is embodied in series voltage regulators of a type wherein the voltage to be regulated or a fixed proportion of it is applied to a potential dividing network comprising a series connection of resistive means and forward-poled semiconductor junction means. The potential developed across resistive means in the potential-dividing network is applied in fixed portion, either directly or indirectly, between the base electrodes of a pair of bipolar transistors in emitter-coupled differential-amplifier, or long-tailed-pair, connection. The collector currents of the transistors are differentially combined in fixed proportions to develop an error signal applied to control the conduction of a series regulating transistor between the source of unregulated voltage and the output circuit across which regulated voltage is available to load means. These fixed proportions are so chosen that the degenerative feedback loop formed by the preceding connections causes a positive-temperature-coefficient (PTC) potential to appear between the base electrodes of the long-tailed pair in order that the loop can carry out its function of reducing error signal. This PTC potential scaled back through the potential dividing network augments the negative-temperature-coefficient (NTC) offset voltage(s) across the forward-poled semiconductor junction means to provide a zero-temperature-coefficient (OTC) potential across at least a portion of the potential-dividing network against which the output voltage of the regulator is regulated.

The present invention is also embodied in current regulators of similar structure to these series voltage regulators.

Figure 7:
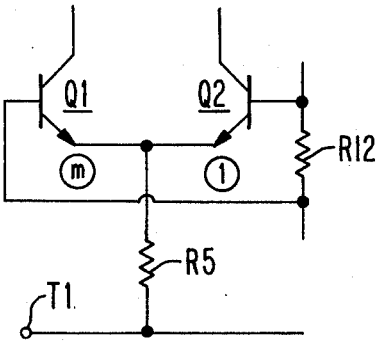
Figure 8:
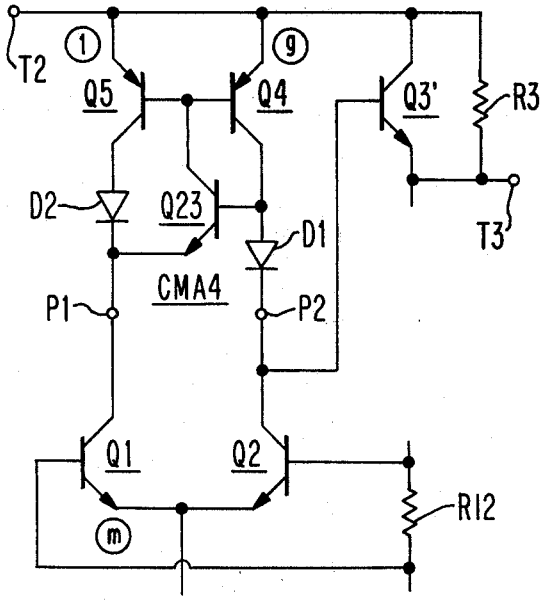
Figure 9:
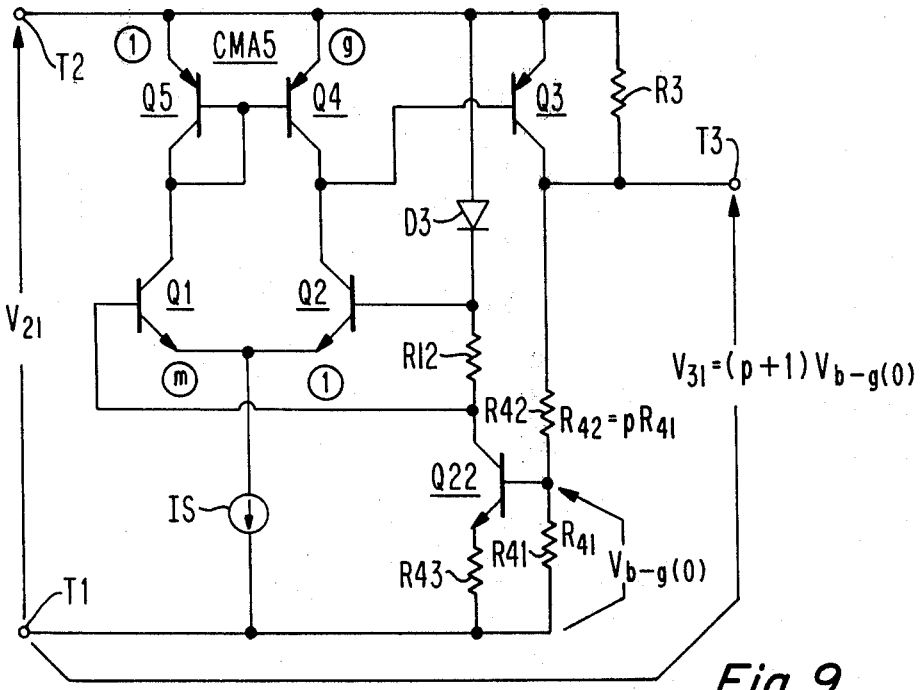
Figure 10:
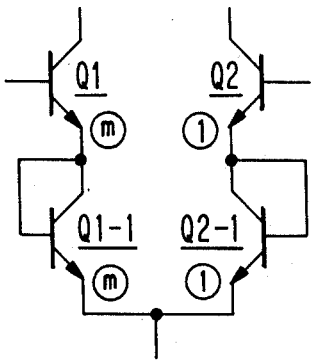
Figure 11:
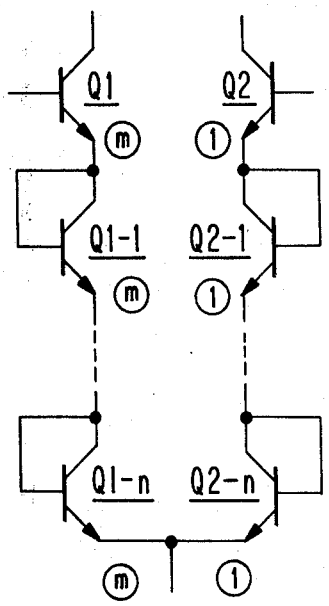
Figure 12:
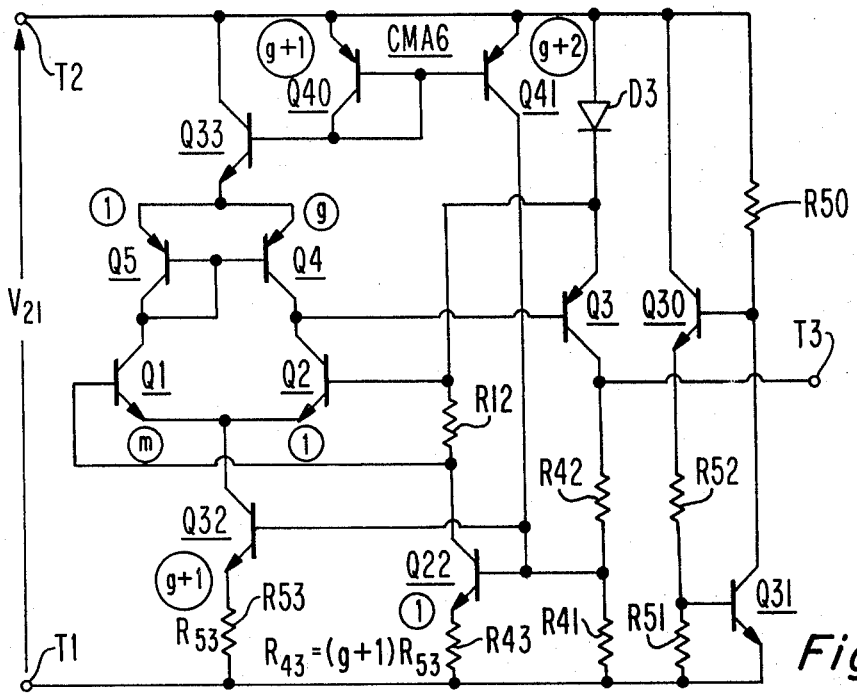

In the drawing:

FIGS. 1, 4, 5, 6, 9, 12 and 13 are schematic diagrams of series regulator circuits embodying the present invention and supplying temperature-compensated regulated voltages;

FIGS. 2, 3, 7 and 8 are schematic diagrams of modifications that can be made to the series regulators of FIGS. 1, 4, 5 and 6, the modified series regulators also embodying the present invention; and FIGS. 10 and 11 are schematic diagrams of modifications readily incorporated into series regulators of the type shown in FIGS. 9 and 12 to form further embodiments of the invention.

Each of these series regulators responds to a voltage $V_{21}$ applied between its terminals T1 and T2 to supply a temperature-compensated regulated voltage $V_{31}$ between its terminals T1 and T3. A path for starting current—e.g., via a resistor R3—is provided between terminals T2 and T3 for shunting the series regulator transistor Q3 or Q3'. In each of these regulators long-tailed pair transistors Q1 and Q2 are of a type that exhibits exponentially varying output current versus applied input voltage, such as a bipolar transistor or a field effect transistor operated in its weak conversion region; and Q1 and Q2 are arranged to be operated at substantially the same temperature. Their output currents are differentially combined in fixed proportions to generate an error signal to control conduction through the series regulator transistor Q3 or Q3'. Increased current flow between terminals T3 and T2 tends to increase the regulated voltage $V_{31}$ appearing between terminals T1 and T3, and a voltage directly related to $V_{31}$ is applied to tend to increase the difference between the input voltages of Q1 and Q2 long-tailed-pair transistors and thus to decrease the error signal.

In FIGS. 1, 4, 5 and 6, Q1 and Q2 are shown as being NPN bipolar transistors having emitter-base junctions, the diffusion profiles of which junctions are assumed to be similar, and the areas of which junctions are in m:1 ratio as indicated by the encircled "m" and "1" next to the emitters of Q1 and Q2, respectively, in being a positive number.

The respective collector currents $I_{C\text{-}Q1}$ and $I_{C\text{-}Q2}$ of Q1 and Q2 are shown as being differentially combined in 1:(1/g) proportion by a current mirror amplifier CMA1 to develop an error signal applied to the base of a PNP series regulator transistor Q3 with emitter connected to terminal T2. CMA1 is shown in FIGS. 1, 4, 5 and 6 to comprise a master mirroring transistor Q4 of complementary conductivity type to Q2, a slave mirroring transistor Q5 of complementary conductivity type to Q1, an input connection to which the collectors of Q2 and Q4 connect and from which direct coupling is made to the bases of Q4 and Q5, an output connection to which the collectors of Q1 and Q5 connect, and a common connection to which the emitters of Q4 and Q5 connect and from which connection is made to a point of operating potential such as terminal T2. The current gain of CMA1 between its input and output connections is made to be $-1/g$, where g is a positive number. As is well known, this may be done by scaling the areas of the emitter-base junctions of Q4 and Q5 in g:1 ratio as indicated by the encircled "g" and "1" next to their respective emitter electrodes, it being assumed these junctions have similar diffusion profiles.

Figure 2:
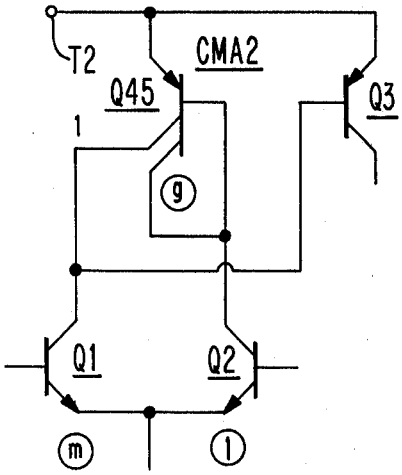

Alternatively, CMA1 may be replaced with another type of current mirror amplifier—e.g., CMA2 of FIG. 2 comprising a dual-collector transistor Q45 having first and second collectors with collection efficiencies in g:1 ratio as indicated by the encircled "g" and "1" next to the first and second collectors, respectively. The first and second collectors of Q45 are at the input and output connections of CMA2; its emitter is at the common connection of CMA2; and its base electrode has the input connection CMA2 direct coupled to it—e.g., by substantially impedance-free direct connection, as shown.

Figure 3:
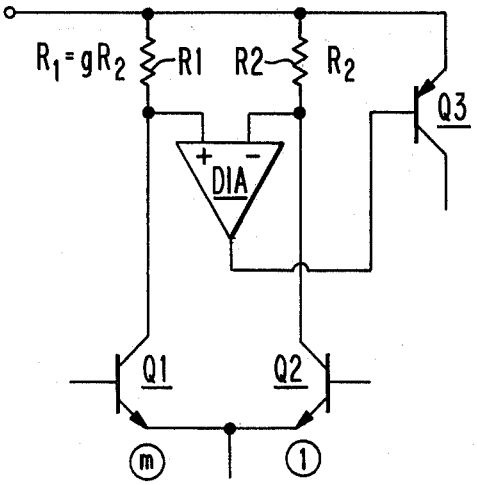

Or, CMA1 may, as shown in FIG. 3, be replaced by equivalent means for combining the collector currents $I_{C\text{-}Q1}$ and $I_{C\text{-}Q2}$ of Q1 and Q2 such as a differential input amplifier DIA arranged to supply error signal from its output connection to the base of series regulator transistor Q3, responsive to the difference between: (a) the potential drop across a Q1 collector load resistor R1 of resistance $R_1$ applied to the non-inverting input connection (+) of DIA, and (b) the potential drop across a Q2 collector load resistor R2 of resistance $R_2=gR_1$ applied to the inverting input connection (−) of DIA.

In any case these arrangements are such that error signal applied to the base of series regulator transistor Q3 will be reduced to negligible value (nominally zero) when the collector current $I_{C\text{-}Q2}$ of Q2 is g times $I_{C\text{-}Q1}$. The difference $\Delta V_{BE}$ that must be maintained between the respective emitter-to-base voltages $V_{BE\text{-}Q1}$ and $V_{BE\text{-}Q2}$ of emitter-connected transistors Q1 and Q2, in order to establish this ratio of their collector currents $I_{C\text{-}Q1}$ and $I_{C\text{-}Q2}$, can be calculated proceeding from the following equation descriptive of transistor operation, derived straight forwardly from the better known equations $$V_{BE}=(kT/q)ln(I_E/AJ_S) \text{ and } I_C=\alpha I_E.$$

$$V_{BE}=(kT/q)ln(I_C/AJ_S\alpha) \quad (1)$$

wherein $V_{BE}$ is the emitter-base potential of the transistor,
k is Boltzmann's constant,
T is the absolute temperature of the transistor,
q is the charge on an electron,
$I_C$ is the collector current of the transistor,
A is the effective area of its emitter-base junction,
$J_S$ is the density of current flow through its emitter-base junction when $V_{BE}=0$, and
$\alpha$ is the ratio of $I_C$ to the emitter current $I_E$ of the transistor, which for a transistor with reasonably high commonemitter forward current gain ($h_{fe}$) approaches unity within a few percent or less.

$J_S$ is the same for any pair of transistors fabricated on the same semiconductor substrate by identical process steps and operated at the same temperature T. The terms other than $J_S$ and T will be identified to a particular transistor by a subscript corresponding to its identification alphanumeric.

$$\Delta V_{BE}=V_{BE\text{-}Q2}-V_{BE\text{-}Q1}=(kT/q)ln(mg) \quad (2)$$

The product of m and g must exceed unity for $V_{BE\text{-}Q2}$ to exceed $V_{BE\text{-}Q1}$. At this point it becomes convenient to consider the series regulators of FIGS. 1–7 separately, one at a time.

In FIG. 1 the collector current $I_{C\text{-}Q3}$, supplied by Q3 responsive to error signal current being demanded from its base, flows through a resistive potential divider comprising serially connected resistors R11, R12 and R13 to forward-bias a diode-connected NPN transistor Q11 with joined collector and base electrodes. Q11 responds to this current flow with an emitter-to-base offset voltage $V_{BE\text{-}Q11}$ of the value associated with emitter current of this value. $V_{BE\text{-}Q11}$ because of the temperature dependency of $J_S$ exhibits a negative-temperature-coefficient (NTC). The voltage drop $V_{PTC}$ across the resistive potential divides will be regulated to a value $[(R_{11}+R_{12}+R_{13})/R_{12}](kT/g)ln(mg)$—where $R_{11}$, $R_{12}$ and $R_{13}$ are the respective resistances of resistors R11, R12 and R13—in order that the divided down potential across R12 will have the value (kT/q)ln(mg) required to reduce to small value the error signal current to the base of Q3. By choosing m, g, and $(R_{11}+R_{12}+R_{13})/R_{12}$ appropriately the positive-temperature-coefficient (PTC) voltage drop $V_{PTC}$ can be made to exhibit increase with increasing temperature that largely offsets the decrease in $V_{BE\text{-}Q11}$ with increasing temperature in the sum of $V_{BE\text{-}Q11}+V_{PTC}$—i.e., the regulated output viltage $V_{31}$ appearing across the series connection of Q11, R11, R12 and R13 between terminals $T_1$ and $T_3$. This temperature-compensated value of $V_{31}$ will be equal to the extrapolated band-gap voltage $V_{b\text{-}g(0)}$ of the semiconductor material from which the transistors are made—e.g., 1.205 volts in the instance where the transistors are silicon ones.

$R_{13}$ can be chosen zero-valued—i.e., R13 can be replaced by direct impedance-free connection—with proper choice of $R_{11}$. R11 must have sufficient resistance $R_{11}$ that the emitters of Q1 and Q2 are at potential between those at T1 and T2 if one wishes to operate with recourse to a power supply potential of polarity opposite to that of $V_{21}$. The tail current for Q1 and Q2 can then, for example, be the collector current of an NPN transistor Q10 that is the slave mirroring transistor of a current mirror amplifier configuration CMA3 of which diode-connected transistor Q11 is the master mirroring transistor.

Figure 4:
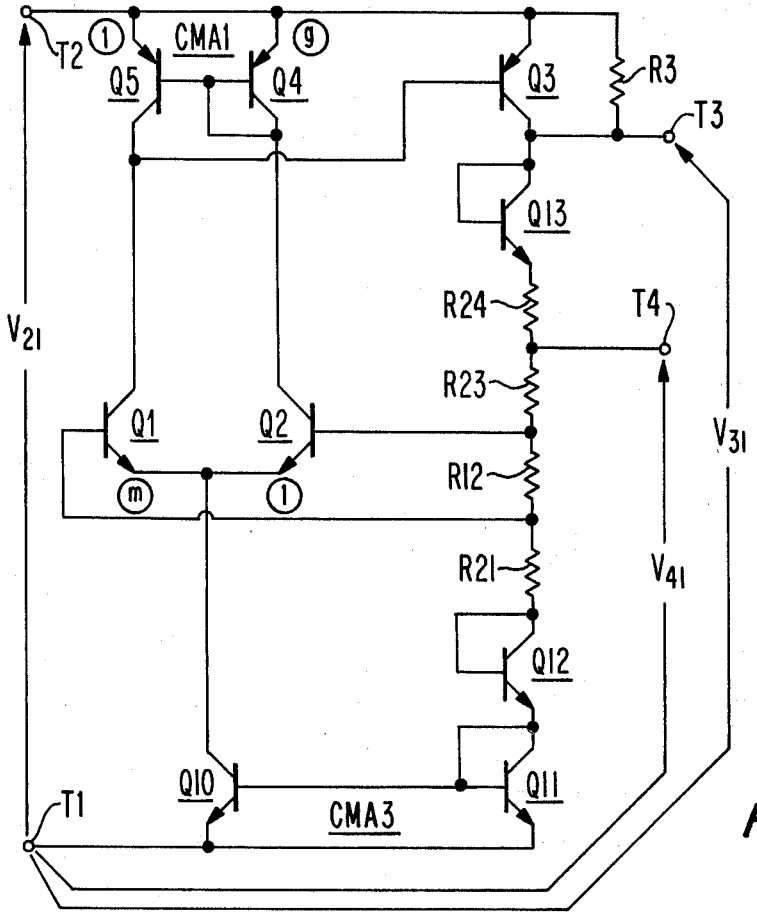

FIG. 4 shows modifications that can be made in the FIG. 1 series regulator to obtain a regulated voltage $V_{41}$ between terminals $T_1$ and $T_4$ that is twice $V_{b\text{-}g(0)}$ and/or a regulated voltage $V_{31}$ that is three times $V_{b\text{-}g(0)}$. Resistors R21, R12, R23 and R24 have respective resistances $R_{21}$, $R_{12}$, $R_{23}$ and $R_{24}$. $V_{41}$ appears across the series connection, in order recited, of diode-connected NPN transistors Q11 and Q12 and of resistors R21, R12 and R23 between terminals T1 and T2. $V_{31}$ appears the series connection, in order recited, of diode-connected NPN transistors Q11 and Q12; of resistors R21, R22, R23 and R24; and of diode-connected NPN transistor Q13. The values of m, g, and $(R_{21}+R_{12}+R_{23})/R_{12}$ are so chosen that the voltage drop across the series connection of R21, R12 and R23 exhibits a positive-temperature-coefficient twice so large as the negative-temperature-coefficient of the offset voltage across each of diode-connected transistors Q11 and Q12, supposing $V_{41}$ is to be temperature-compensated. The values of m, g, and $(R_{21}+R_{12}+R_{23}+R_{24})/R_{12}$ are so chosen that the voltage drop across the series connection of R21, R12, R23 and R24 exhibits a positive-temperature-coefficient thrice so large as the negative-temperature-coefficient offset voltage across each of diode-connected transistors Q11, Q12 and Q13, supposing $V_{31}$ is to be temperature-compensated. If only a temperature-compensated $V_{41}=2V_{b\text{-}g(0)}$ is of interest, the series connection of R24 and diode-connected Q13 can be replaced by a direct impedance-free connection. If only a temperature-compensated $V_{31}=3V_{b\text{-}g(0)}$ is of interest, R23 and R24 can be a single resistor; and/or diode-connected transistor Q13 can be moved respective to the diode-connected transistors Q11 and Q12 and resistors R21, R12, R23 and R24 it is in series connection with, so long as it is not interposed between the bases of Q1 and Q2. Either $R_{21}$ or $R_{23}$ can be zero-valued—i.e., one of resistors R21 and R23 can be replaced by direct connection.

Figure 5:
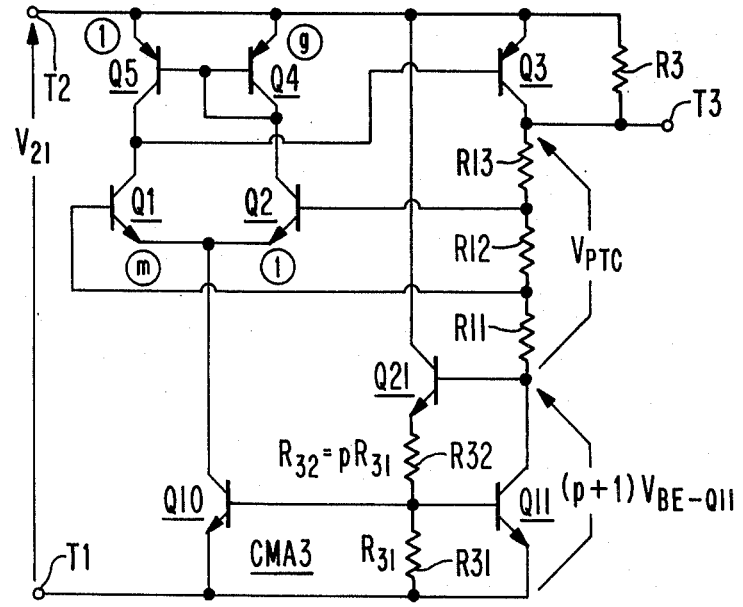

FIG. 5 shows a modified form of the FIG. 1 series regulator that will provide a temperature-compensated voltage $V_{31}$ equal to any factor, equal to or greater than two times $V_{b\text{-}g(0)}$. Rather than Q11 being provided direct-coupled feedback by impedance-free direct connection of its collector to its base to regulate its emitter-to-collector voltage $V_{CE\text{-}Q11}$ to equal its emitter-to-base voltage $V_{BE\text{-}Q11}$, Q11 is provided direct-coupled collector-to-base feedback via an NPN emitter-follower transistor Q21 and a resistive potential divider comprising resistors R31 and R32 with respective resistances $R_{31}$ and $R_{32}$ in 1:p ratio. So $V_{CE\text{-}Q11}$ is regulated to $(p+1)$ $V_{BE\text{-}Q11}$ in the FIG. 3 series regulator. To obtain a temperature-compensated $V_{31}$ equal to $(p+1)$ times $V_{b\text{-}g(0)}$, the values of m, g, and $(R_{11}+R_{12}+R_{13})/R_{12}$ are chosen so that $V_{PTC}$ exhibits a positive-temperature-coefficient $(p+1)$ times as large as the negative-temperature-coefficient of $V_{BE\text{-}Q11}$. Either $R_{11}$ or $R_{13}$ can be made zero-valued.

The FIG. 5 regulator can be modified dispensing with Q10 and applying the collector current of Q21 as tail current to the interconnected emitters of Q1 and Q2. Or Q10 can be retained and the combined collector currents Q10 and Q21 can be applied as the tail current. Modifying the FIG. 5 series regulator by replacing emitter-follower Q21 with a zero-offset potential follower will result in series regulator in which $V_{31}$ can be any factor, equal to or greater than unity, times $V_{b\text{-}g(0)}$.

Figure 6:
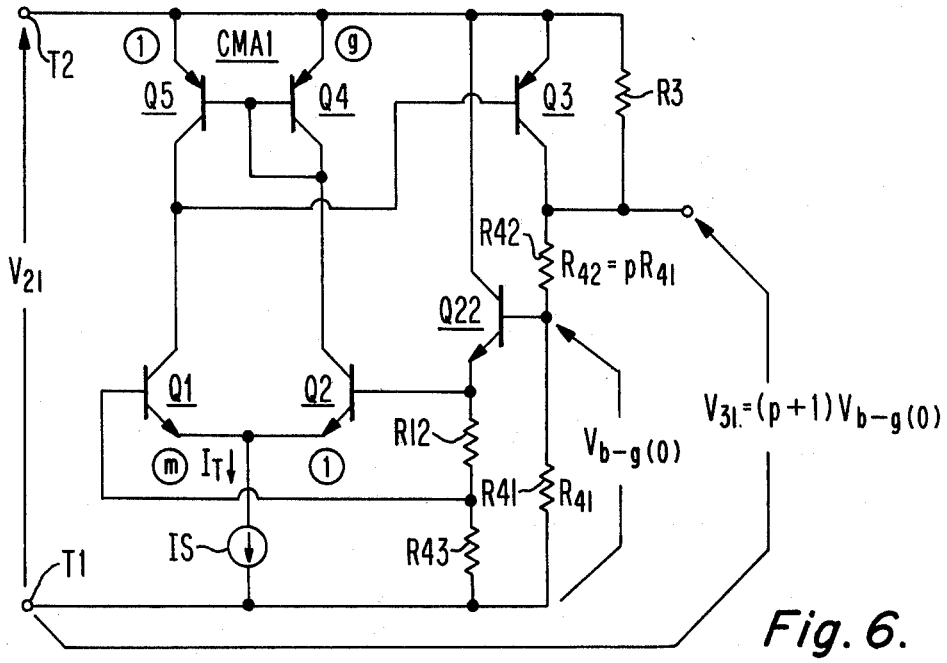

FIG. 6 shows a somewhat simpler way to achieve such widened range for a $V_{31}$ regulated to be equal to $(p+1)V_{b\text{-}g(0)}$. Tail current $I_T$ flows to terminal T1 via current source IS from the interconnection between the emitters of Q1 and Q2. A resistive potential divider comprising serially connected resistors R41 and R42 with respective resistance R41 and R42 in 1:p ratio divides $V_{31}$ by $(p+1)$ for application to the base of an NPN emitter follower transistor Q22. The emitter potential $[V_{31}/(p+1)]-V_{BE\text{-}Q22}$ of Q22 is divided by a resistive potential divider comprising resistors R12 and R43 with respective resistances $R_{12}$ and $R_{43}$ to apply a $\Delta V_{BE}=\{[V_{31}/(p+1)]-V_{BE\text{-}Q22}\}\ [R_{12}/(R_{12}+R_{43})]$ between the bases of Q1 and Q2. So then, since $\Delta V_{BE}=(kT/q)\ln(mg)$ from equation 2, the following value is obtained for $V_{31}$ by substituting for $\Delta V_{BE}$.

$$V_{31}=(p+1)\{V_{BE\text{-}Q22}+[(R_{12}+R_{43})/R_{12}](kT/q)\ln(mg)\} \quad (3)$$

The ratio $(R_{12}+R_{43})/R_{12}$ is chosen equal to the value of $(R_{11}+R_{12}+R_{13})/R_{12}$ in the FIG. 1 series regulator to obtain a $V_{31}$ in the FIG. 6 series regulator that is equal to $(p+1)$ times $V_{b\text{-}g(0)}$. Overly large $(p+1)$ division ratios can be avoided when large values are sought for $V_{31}$ by introducing one or more additional diode-connected transistors in series with R43 and R44, so long as there is no diode-connected transistor interposed between the bases of Q1 and Q2.

Since there are potentials applied to the base electrodes of Q1 and Q2 that are regulated, although their regulation may (as in FIG. 4) exhibit temperature dependency, the voltage at the interconnection of their emitter electrodes is regulated also by their potential-offsetting emitter-follower action. So a reasonably well-defined tail current can be drawn from this interconnection by connecting a resistor R5 from it to terminal T1, as shown in FIG. 7. This can be done in any of the series regulators described herein, but is particularly convenient in the FIG. 6 regulator since there is no diode-connected transistor Q11 to serve as master mirroring transistor to a slave mirroring transistor Q10 in a CMA3.

A distinguishing feature of the series voltage regulators of FIGS. 1, 4, 5 and 6 when comparing them to the shunt voltage regulators described by Wheatley, Jr. in his U.S. Pat. Nos. 3,851,241 and 4,088,941 is that in each of the series regulators the collector current of Q1 is not inverted and the collector current of Q2 is inverted when they are differentially combined in 1:−g ratio in CMA1 with −1/g current gain, for application to the base of a regulating transistor Q3 of conductivity type complementary to that of Q1 and Q2. In shunt regulators of the type described by Wheatley, Jr. on the other hand, collector currents of long-tailed-pair transistors corresponding to Q1 and Q2 are inverted and not inverted, respectively, when they are differentially combined in −1:g ratio in a current mirror amplifier with −g current gain, for application to the base of a regulating transistor of conductivity type complementary to that of the long-tailed-pair transistors. This difference is necessary because the complementary-conductivity series regulator transistor is an inverting amplifier in the regulator feedback loop, while the complementary-conductivity shunt regulator transistor is non-inverting. Now, when g is larger than unity, shunt regulators of the type described by Wheatley, Jr. supply error signal to the regulator transistor from the half of the unbalanced differential amplifier in which the larger current levels are found. When g is larger than unity, series regulators of the type of which the regulators of FIGS. 1, 4, 5 and 6 are examples, supply error signal to the regulator transistor from the half of the unbalanced differential amplifier in which the smaller currents are found. This is a disadvantage insofar as the open-loop current gain of the regulator is concerned and error signals must be larger to support conduction in the regulator transistor Q3.

Of course, the current gain of Q3 can be made larger—for example, by making it a composite transistor with PNP input component transistor and NPN output component transistor in complementary Darlington cascade connection. Or one can use a field effect transistor for Q3 to make a regulator loop with no static error signal.

In FIG. 8 the series regulator transistor Q3 of conductivity type complementary to that of Q1 and Q2, which acts as an inverting common-emitter amplifier, is replaced by series regulator transistor Q3' of the same conductivity type as Q1 and Q3. Q3' acts as a non-inverting commoncollector amplifier, receiving an error signal at its base essentially equal to the collector current of Q2 less the collector current of Q4. Q4 is the slave mirroring transistor of current mirror amplifier CMA4, rather than its master mirroring transistor; and Q5 is the master mirroring transistor of current mirror amplifier CMA4, rather than its slave mirroring transistor. I.e., the input connection of CMA4 is at point P1 from which the collector current $I_{C\text{-}Q1}$ of Q1 is withdrawn; and the output connection of CMA4 is at point P2 from which a current $-g$ times $I_{C\text{-}Q1}$ is supplied. An error signal current is supplied to the base of Q3, then, from the high-current side of the unbalanced differential amplifier connection.

CMA4 preferably is a current mirror amplifier of a type in which the potential at its input connection to point P1 follows the potential at its output connection to point P2. As shown, such an amplifier is provided by connecting point P1 to the joined base electrodes of Q4 and Q5 via the emitter-to-collector path of an NPN common-base amplifier transistor Q23, the base electrode of Q23 being offset from point P2 by the one-$V_{BE}$ offset voltage across a semiconductor diode D1. D1 conventionally will consist of a collector-base shorted NPN transistor. So will diode D2, inserted between point P1 and the collector of Q5 to equalize the emitter-to-collector potentials $V_{CE\text{-}Q4}$ and $V_{CE\text{-}Q5}$ of Q4 and Q5 and thus improve the matching of their conduction characteristics.

FIG. 9 shows how the FIG. 6 series regulator can be modified so that the error signal current is supplied to the base of Q3 from the high-current side of the unbalanced differential amplifier. Q22 is re-connected as a common-emitter amplifier with R12 in its collector, rather than its emitter circuit, and R43 is retained in its emitter circuit. This common-emitter amplifier introduces an extra inversion into the regulator feedback loop so that the error signal can be $I_{C\text{-}Q2}-I_{C\text{-}Q1}$, rather than having to be $I_{C\text{-}Q1}-I_{C\text{-}Q2}$, in order to make the loop degenerative in character. Q5 and Q4 are then connected as the master and slave mirroring transistors, respectively, of current mirror amplifier CMA5, which responds to its input current withdrawn as collector current to Q1 with an output current $-g$ times as large differentially combined with the collector current of Q2 to develop error signal current applied as base current to series regulator transistor Q3. Diode D3 connected between terminal T2 and the base of Q2, to be in series with R12 for conducting the collector current of Q22, offsets the base potential of Q2 from the operating voltage at terminal T2 sufficiently that the collector-base junctions of Q1 and Q2 are maintained reverse-biased for operating Q1 and Q2 in normal transistor operating mode. Using the one-$V_{BE}$ offset afforded by D3, Q1 and Q2 have nearly zero-valued emitter-to-collector voltages virtually eliminating any collector leakage currents. The respective resistances $R_{12}$ and $R_{43}$ of resistors R12 and R43 are chosen such that the potential drop across R43 augments the emitter-to-base offset voltage $V_{BE\text{-}Q22}$ of Q22 to produce $V_{b\text{-}g(0)}$ at the base of Q22 when the error signal current applied to the base of Q3 is reduced to equilibrium value. Owing to the similar values of current flowing through R41 and R42 with respective resistances $R_{41}$ and $R_{42}=pR_{41}$, $V_{31}$ across their series connection will have a value close to $(p+1)V_{b\text{-}g(0)}$ for this equilibrium condition.

FIG. 10 shows a modification that can be made to the FIG. 9 series regulator to reduce the ratio of $R_{43}$:$R_{12}$ towards unity and thus allow the ratio to be more accurately maintained for given yield over the course of manufacturing. The biasing of the bases of Q1 and Q2 offset by only a diode drop and by slightly more respectively from the voltage at terminal T2 makes it possible to insert diode-connected NPN transistors Q1-1 and Q2-1 between the tail connection and their respective emitters to double the voltage offset. The regulator feedback loop maintains between their bases under equilibrium conditions. FIG. 11 shows a first plurality of diode-connected transistors Q1-1 . . . Q1-n, n in number, inserted between the tail connection and the emitter of Q1 and shows a second plurality of diode-connected transistors Q2-1 . . . Q2-n, also n in number, inserted between the tail connection and the emitter of Q2. This results in a voltage of $(kT/q)\ln(mg)^n$ being maintained between the bases of Q1 and Q2. These modifications can reduce the area on the integrated circuit die required to develop a given offset voltage between the bases of Q1 and Q2 by choosing g larger than n.

FIG. 12 shows a modification of the FIG. 9 series regulator in which the effects of the base currents of Q1, Q2, and Q22 are compensated against, as to be explained. The path for starting current between terminals T2 and T3 is the collector-to-emitter path of an NPN transistor Q30 initially held conductive by R50 connected between its base and terminal T2. The voltage $V_{31}$ between terminals T1 and T3 is divided down by the resistive potential divider comprising resistors R51 and R52 in series connection for application to NPN common-emitter amplifier transistor Q31. The ratio of the respective resistances $R_{51}$ and $R_{52}$ of resistors R51 and R52 are so chosen that Q31 is non-conductive until $V_{31}$ approaches its design value during startup, after which Q31 conducts to clamp the base of Q30 to the potential at terminal T1, reverse-biasing the emitter-base junction of Q30 and thus removing it from conduction. This starting circuit can save power dissipation, since R50 can be made several times as large in resistance as R3 could be and the current flow through resistive potential divider R51, R52 can be made smaller than the current flow through R50 by a factor approaching the common-emitter forward current gain ($h_{fe}$) of Q31.

Of primary interest in FIG. 12, however, is the base current compensation scheme. NPN transistor Q32 with emitter degeneration resistor R53 has its collector connected to withdraw tail current from the interconnected emitters of Q1 and Q2, and its base-emitter circuit parallels that of NPN transistor Q22 with emitter degeneration resistor R43. The emitter-base junctions of Q22 and Q32 are assumed to have similar diffusion profiles and to have effective areas in $1:(g+1)$ ratio, as indicated by the encircled "1" and "g+1" near their respective emitters; and resistors R43 and R53 have respective resistances $R_{43}$ and $R_{53}$ in (g+1):1 ratio. So the tail current demanded by Q32 as its collector current $I_{C\text{-}Q32}$ is (g+1) times as large as the current $I_{C\text{-}Q22}$ flowing to the collector of Q22. Since the regulator feedback loop acts to reduce error signal current supplied to the base of Q3 by adjusting the currents through the collector-to-emitter paths of Q1 and Q2 to be in substantially 1:g ratio, the current flowing through the collector path of Q1 is substantially $I_{C\text{-}Q32}/(g+1)$. Since the collector currents of Q1 and Q22 are substantially equal, their base currents to support these collector currents are substantially equal, presuming Q1 and Q22 to have substantially equal $h_{fe}$'s. The base current of Q1, then, augments $I_{C\text{-}Q22}$ to make a current flow through R12 substantially equal to the emitter current of Q22 flowing through R43, the sum of the base and collector currents of a transistor equalling its emitter current in order to satisfy Kirchoff's Law of Currents. So, since the currents through R12 and R43 are more closely equal, the potential drops across R12 and R43 are more closely scaled according to their respective resistances $R_{12}$ and $R_{43}$.

Compensation against the error in potential division, that would otherwise occur in the resistive potential divider formed by R41 and R52, is provided in the following way. After $I_{C\text{-}Q32}$ is apportioned between the collector-to-emitter paths of Q1 and Q2 the portions are rejoined at the common connection of CMA5 to present a demand for emitter current upon NPN common-collector transistor Q33, which demand is substantially equal to $I_{C\text{-}Q32}$ and has to be supported by a base current $I_{B\text{-}Q32}$ substantially equal to that of Q32. This base current $I_{B\text{-}Q32}$ is withdrawn from the input connection of current mirror amplifier CMA6. CMA6 comprises PNP master mirroring transistor Q40 and PNP slave mirroring transistor Q41 with current flows in (g+1):(g+2) ratio; and its output connection from the collector of Q41 supplies the base current needs of Q22 and Q32.

Figure 13:
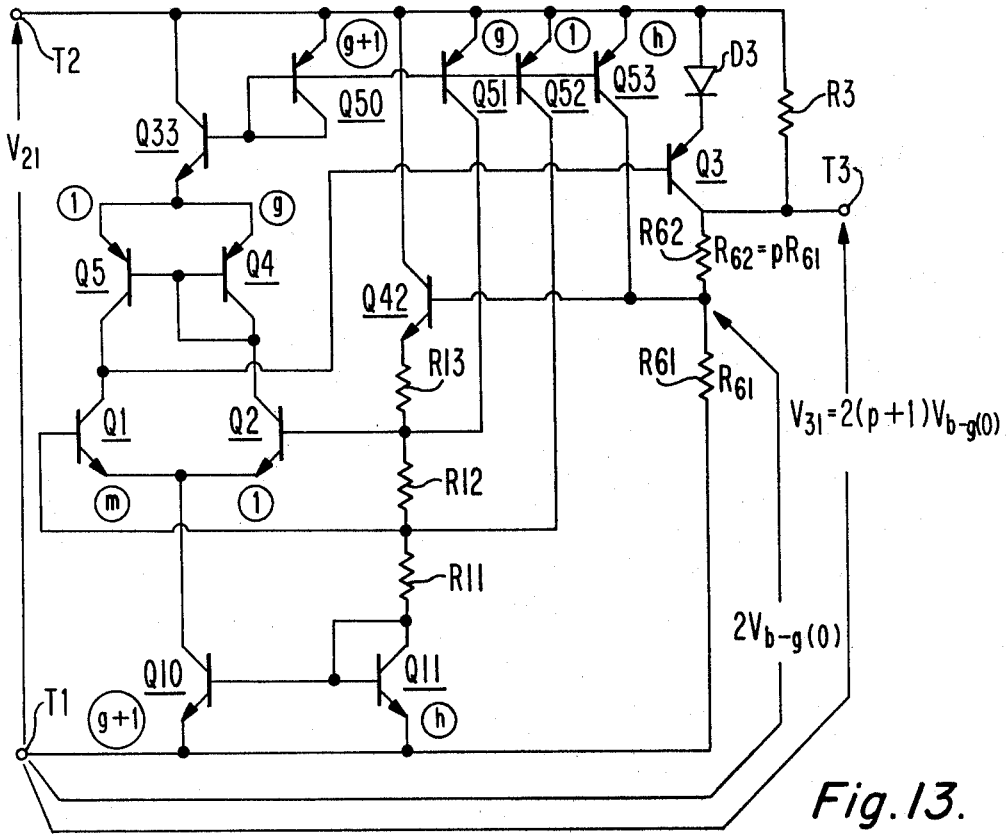

FIG. 13 shows how this latter compensation scheme can be expanded to fit the needs of a series regulator more like those of FIGS. 1, 4, 5, and 6. Here the base current of Q33 is supplied through the input circuit of a multiple-output current mirror amplifier comprising, in addition to PNP master mirroring transistor Q50, PNP slave mirroring transistors Q51, Q52, Q53. The conduction of Q51 and the conduction of Q52 are chosen relative to the conduction of Q50 so the collector currents of Q51 and Q52 supply the base current needs of Q1 and Q2, respectively. The division of $V_{31}$ by the resistive potential divider formed by the series connection of resistors R61 and R62 with respective resistances $R_{61}$ and $R_{62}$ in 1:p ratio would depart from division by (p+1):1 ratio, owing to the base current loading of NPN emitter-follower transistor Q42 used to apply the divided voltage to a further resistive potential divider comprising R11, R12 and R13, were it not for Q53 collector current supplying the base current need of Q42. The encircled "g+1" and "h" near the emitter of Q10 and Q11 indicate their relative collector currents for given emitter-to-base voltage, and the encircled "g+1", "g", "1" and "h" near the emitters of Q50, Q51, Q52 and Q53 indicate their relative collector currents for given emitter-to-base voltage.

A very interesting aspect of the series voltage regulators described above is that each behaves as a current regulator between its terminals T1 and T2. Where current regulation, rather than temperature-compensated voltage regulation is sought, the regulator circuits may reflect this in structure being modified or in element values being changed. Particularly, there would be no absolute need for developing a negative-temperature-coefficient voltage to which the scaled-up voltage across R12 can be added. As particular examples, where the tail interconnection of the emitters of Q1 and Q2 is connected to terminal T1 thorugh a resistor R5 in modified forms of the FIG. 1, 4 or 5 series regulator, one may replace the negative-temperature-coefficient generating circuitry with a direct connection, scaling up the resistance of R11 or R21 to develop increased voltage drop thereacross to compensate for the lost voltage offset from terminal T1. Or, the scaling of resistors to develop positive-temperature-coefficient offset potentials may vary from that required to develop a zero-temperature-coefficient $V_{31}$.

The emitter-to-base voltages established for several of the transistors in the series regulators described above for establishing their collector currents can be applied to emitter-to-base voltages of additional transistors conditioning them to source or sink currents of predetermined value through their collector electrodes. E.g. the emitter-to-base voltages of Q3, Q4, Q10 or Q45 can be so used. Other arrangements where additional transistors have base circuits paralleling those of transistors in these series regulators are possible as well; transistors with appropriate emitter degeneration may have base circuits paralleling those of Q3', Q21 and Q22, for example.

It may be necessary to by-pass the regulatory loop of these series regulators for high frequencies at a suitable point, if the tendency towards self-oscillation of the loop is not adequately suppressed by stray capacitance. To this end a capacitor may be used for by-passing the base of Q3 directly to terminal T1 or T2. Or Q3 may have a capacitor connected between its collector and base, the resulting Miller capacitance being used to establish a primary time constant for rolling off the frequency response of the regulator loop.

The use of film resistors, rather than diffused resistors in the potential scaling networks is advantageous in that it eliminates a source of temperature variation in the $V_{BE}$ offsets of associated transistors. The use of p-channel metal-oxide-semiconductor field effect transistors rather than lateral-structure PNP's for Q3, Q4, Q5 is advantageous where a monolithic integrated-circuit regulator is to be used at elevated temperatures, because the tracking errors due to parasitic transistors to substrate are avoided. Q1 and Q2 may be replaced by field effect transistors operated in the sub-threshold or weak inversion region of their operating characteristics. Though the following claims are drawn using the terms "base", "emitter" and "collector" with respect to the transistors called for therein, these terms should be construed to refer to the "gate", "source" and "drain" respectively of field effect transistors where appropriate, there being no widely used generic terms in English language for the electrodes of any type of transistor.

What is claimed is:

1. A series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantially equal to T;

a third, series regulator transistor, having the ends of a principal current conduction path thereof defined by first and second electrodes respectively connected to said second terminal and to said third terminal, and having a third control electrode, the potential between which and one of its said first and second electrodes controls the conductivity of its principal current conduction path between its first and second electrodes;

a potential divider network comprising a series connection of resistive means and of forward-poled semiconductor junction means between said first terminal and a point of connection to which at least a portion of the potential at said third terminal is applied;

means for applying potential developed across resistive means in said potential divider network in fixed portion between the base electrodes of said first and second transistors;

means for providing a path for current of predetermined value between said first terminal and an interconnection between the emitter electrodes of said first and second transistors; and means for differentially combining in fixed proportions currents received from the collector electrodes of said first and second transistor to develop and error signal applied to the third electrode of said series regulator transistor.

2. A series voltage regulator as set forth in claim 1 wherein said series regulator transistor is of a second conductivity type complementary to said first conductivity type and wherein said means for differentially combining comprises:

fourth and fifth transistors of said second conductivity type, each having the ends of a principal current conduction path thereof defined by first and second electrodes thereof and having a respective third control electrode, the first electrodes of said fourth and fifth transistors being connected to said second terminal, the collector electrode of said second transistor and the second electrode of said fourth transistor connecting to a node direct coupled to the third electrodes of said fourth and fifth transistors, and the collector electrode of said first transistor and the second electrode of said third transistor connecting to a node direct coupled to the third electrode of said third transistor.

3. A series voltage regulator as set forth in claim 1 wherein said series regulator transistor is of similar conductivity type to said first and second transistors and wherein said means for differentially combining comprises:

fourth and fifth transistors of a second conductivity type complementary to said first conductivity type, each having the ends of a principal current path thereof defined by first and second electrodes thereof and having a respective third control electrode, the first electrodes of said fourth and fifth transistors being connected to said second terminal, the collector electrode of said second transistor and the second electrode of said fourth transistor connecting to a node direct coupled to the third electrode of said third transistor, and the collector electrode of said first transistor and the second electrode of said fourth transistor connecting to a node direct coupled to the third electrodes of said fourth and fifth transistors.

4. A series voltage regulator as set forth in claim 1 wherein said forward-poled semiconductor junction means in said potential divider network includes:

fourth and fifth transistors of said first conductivity type, having respective base and emitter and collector electrodes, the emitter electrode of said fourth transistor being connected at said first terminal, the collector electrode of said fourth transistor being connected to the base of said fifth transistor and thence through said resistive means to said third terminal, and the collector electrode of said fifth transistor being connected to said second terminal; and potential dividing means for applying between said first terminal and the base electrode of said fourth transistor a portion of the potential appearing between said first terminal and the emitter electrode of said fifth transistor.

5. A series voltage regulator as set forth in claim 4 wherein said means for providing a path for current of predetermined value includes:

a sixth transistor of said first conductivity type having a collector electrode connected to said interconnection between the emitter electrodes of said first and second transistors, having an emitter electrode connected to said first terminal, and having a base electrode to which said portion of the potential appearing between said first terminal and the emitter electrode of said fifth transistor is applied.

6. A series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantially equal to T;

a third, series regulator transistor of a second conductivity type complementary to said first conductivity type, having an emitter electrode connected to said second terminal, having a collector electrode connected to said third terminal, and having a base electrode to which the collector electrode of said first transistor connects;

a potential divider network comprising a series connection of resistive means and of forward-poled semiconductor junction means between said first terminal and a point of connection to which at least a portion of the potential at said third terminal is applied;

means for applying potential developed across said resistive means in said potential divider network in fixed portion between the base electrodes of said first and second transistors;

means for providing a path for current of predetermined value between said first terminal and an interconnection between the emitter electrodes of said first and second transistors; and a current amplifier having an input connection from the collector electrode of said second transistor, having an output connection to the base electrode of said third transistor; having a common connection to said second terminal, and exhibiting a current gain of $-g$ between its input and output connections, g being a positive number.

7. a series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantially equal to T;

a third, series regulator transistor, having the ends of a principal current conduction path thereof defined by first and second electrodes respectively connected to said second terminal and to said third terminal, and having a third control electrode, the potential between which and one of its said first and second electrodes controls the conductivity of its principal current conduction path between its first and second electrodes;

a potential divider network comprising a series connection of resistive means and of forward-poled semiconductor junction means between said first terminal and a point of connection to which at least a portion of the potential at said third terminal is applied;

means for applying potential developed across resistive means in said potential divider network in fixed portion between the base electrodes of said first and second transistors;

means for providing a path for current of predetermined value between said first terminal and an interconnection between the emitter electrodes of said first and second transistors;

first and second resistors having respective first ends connected to one of said second and third terminals and having respective second ends to which the collector electrodes of said first and second transistors respectively connect; and a differential-input amplifier having a first of its input connections at the second end of said first resistor, having a second of its input connections at the second end of said second resistor, and having an output connection to the base electrode of said third transistor for completing a regenerative feedback loop.

8. A series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantiallly equal to T;

a third, series regulator transistor of said first conductivity type having a collector electrode connected to said second terminal, having an emitter electrode connected to said third terminal, and having a base electrode;

a potential divider network comprising a series connection of resistive means and of forward-poled semiconductor junction means between said first terminal and a point of connection to which at least a portion of the potential at said third terminal is applied;

means for applying potential developed across resistive means on said potential divider network in fixed portion between the base electrodes of said first and second transistors;

means for providing a path for current of predetermined value between said first terminal and an interconnection between the emitter electrodes of said first and second transistors; and a current amplifier having an input connection from the collector electrode of said first transistor, having an output connection to a node to which the collector electrode of said second transistor is connected and from which direct coupling is made to the base electrode of said third transistor, having a common connection to said second terminal, and exhibiting a current gain of $-1/g$ between its input and output connections, g being a positive number.

9. A series voltage regulator as set forth in claim 6, 7 or 8 wherein said forward-poled semiconductor junction means in said potential divider network includes a fourth transistor of said first conductivity type having an emitter electrode connected at said first terminal, having a collector electrode to which the remaining portion of the series connection of resistive means and forward-poled semiconductor junction means connects, and having a base electrode to which its collector electrode is direct coupled; and wherein said means for providing a path for current of predetermined value includes a fifth transistor of said first conductivity type having an emitter electrode connected at said first terminal, having a collector electrode connected to the interconnection of the emitter electrodes of said first and second transistors, and having a base electrode connected to receive essentially the same base potential as said fourth transistor.

10. A series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantially equal to T;

a third, series regulator transistor, having the ends of a principal current conduction path thereof defined by first and second electrodes respectively connected to said second terminal and to said third terminal, and having a third control electrode, the potential between which and one of its said first and second electrodes controls the conductivity of its principal current conduction path between its first and second electrodes;

a fourth transistor of said first conductivity type having a collector electrode connected to said second terminal, and having base and emitter electrodes;

means for applying a potential between said first terminal and the base electrodes of said fourth transistor which potential is in fixed ratio to the potential between said first and third terminals;

tapped resistance means connected between the emitter of said fourth transistor and said first terminal, with the potential developed across a portion of said resistance means being applied between the base electrodes of said first and second transistors;

means for providing a path for current of predetermined value between said first terminal and an interconnection of the emitter electrodes of said first and second transistors; and means for differentially combining in fixed proportions currents received from the collector electrodes of said first and second transistor to develop an error signal applied to the third electrode of said series regulator transistor.

11. A series voltage regulator for responding to an unregulated voltage received between first and second terminals for supplying regulated voltage between said first terminal and a third terminal which regulated voltage is compensated against variations in a temperature T, said regulator comprising:

first and second transistors of a first conductivity type each having respective base, emitter and collector electrodes, exhibiting a logarithmic collector current response to its emitter-to-base voltage, and being arranged for operation at a respective temperature substantially equal to T;

a fourth transistor of said first conductivity type having base, emitter, and collector electrodes;

means for applying a potential between said first terminal and the base electrode of said fourth transistor which potential is in fixed ratio to the potential between said first and third terminals;

first and second resistors having respective resistances in fixed ratio between respective first and second ends of each of them, said first resistor connected at its first end to said first terminal and at its second end to the emitter electrode of said fourth transistor, and said second resistor connected at its first end to the base electrode of said first transistor and at its second end to the base electrode of said second transistor, the collector electrode of said fourth transistor being connected to the first end of said second resistor;

means for providing a voltage offset between said second terminal and the second end of said second resistor; and means for differentially combining in fixed proportions currents received from the collector electrodes of said first and second transistor to develop an error signal applied to the third electrode of said series regulator transistor.

12. A series voltage regulator as set forth in claim 11 wherein said means for providing a path for current of predetermined value includes:

a fifth transistor of said first conductivity type having base and emitter electrodes and having a collector electrode connected to said interconnection between the emitter electrodes of said first and second transistors;

means for applying a base potential to said fifth transistor equal to that applied to said fourth transistor; and a third resistor having a resistance, in fixed ratio to those of said first and second resistors, between a first end connected at said first terminal and a second end connected at the emitter of said fifth transistor.

13. A series voltage regulator as set forth in claim 1, 2, 3, 4, 5, 6, 7, 8, 10 or 11 wherein the emitters of said first and second transistors are connected without substantial intervening impedance to said interconnection between them.

14. A series voltage regulator as set forth in claim 1, 2, 3, 4, 5, 6, 7, 8, 10 or 11 wherein the emitters of said first and second transistors are connected to said interconnection between them by paths, each of which passes through the same number of forward-poled diode means as the other.

* * * * *